US005401550A

United States Patent [19]

Hannon

[11] Patent Number: 5,401,550

[45] Date of Patent: Mar. 28, 1995

[54] DEVICE FOR CLEANING BETWEEN TOES

[76] Inventor: Ronald M. Hannon, 5 Falcon Dr., Pelham, N.H. 03076

[21] Appl. No.: 99,193

[22] Filed: Jul. 29, 1993

[51] Int. Cl.[6] ..... B32B 1/00

[52] U.S. Cl. ..... 428/66; 428/64; 428/99; 15/222

[58] Field of Search ..... 428/64, 66, 99; 15/160, 15/222

[56] References Cited

U.S. PATENT DOCUMENTS 1,628,023 5/1927 Adkins ..... 15/222

3,936,198 2/1976 Martin ..... 15/222

*Primary Examiner*—Alexander S. Thomas

*Attorney, Agent, or Firm*—Edward A. Gordon

[57] ABSTRACT

The present invention discloses a device for cleaning the area between toes of a user including a base device forming sufficient top and bottom horizontal areas capable of being releasably secured by one foot of the user; an elongated flexible cord line device having a lower end and an upper end whereby the lower end is adapted to be attached to the base device and the upper end is adapted to be held by a hand of a user; and the elongated flexible cord line device is such that it enters the area between toes of the user's foot whereby the user's foot is raised and lowered up and down the flexible cord line to thereby clean the areas between the toes.

7 Claims, 3 Drawing Sheets

DEVICE FOR CLEANING BETWEEN TOES

BACKGROUND OF THE INVENTION

1. Field Of The Invention

The present invention relates generally to devices for toes and more particularly to a new and improved device for appropriately cleaning and/or massaging the spaces between toes.

2. Description Of Prior Art

A search for prior art patents relating to toe treating devices resulted in the following patents.

U.S. Pat. No. 3,531,814 discloses a toe cleaning device which comprises a rod having an upper end and a lower end. The upper end forming a handle capable of being grasped by a hand of a user and the length of the rod being such that the lower end thereof reaches the toes of the user when the user grasps the handle and without requiring the user to bend substantially and a substantially bell-shaped or conical toe cleaning member mounted on the lower end of the rod. The toe cleaning member having a wide end and a narrow end, and a toe cleaning surface tapering from one end to the other. One half of the toe cleaning surface being constituted by bristles forming a brush and the other half of the toe cleaning surface being constituted by a sponge, each half extending from one end to the other and the toe cleaning member being of a size to fit between adjacent toes.

U.S. Pat. No. 5,039,093 discloses a toe exercise device which includes an elongated flexible body having an opening at one end designed to fit over one's leg above the knee. The device includes, at another end, a plurality of attachment devices, one for each of the toes of the user. The attachment devices are made of a woven material designed to contract radially as they are stretched longitudinally so that their connection over the respective toes is maintained as the device is stretched. The device is designed to be used to exercise one's toes.

The foregoing patents as well as the following U.S. Patents are believed to exemplify the present state of the art with respect to the search for toe cleaning devices:

U.S. Pat. No. 2,066,443

U.S. Pat. No. 2,251,767

U.S. Pat. No. 3,296,644

While such prior art devices provide improvements in the areas intended, there still exists a great need for a device for treating between toes which overcomes the disadvantages of the prior art devices and provides a device which provides a flossing type motion to appropriately clean and/or massage the spacing between toes.

Accordingly a principle desirable object of the present invention is to overcome the disadvantages of the prior art.

Another principle desirable object of the present invention is to provide a device to appropriately clean and/or massage the spacing between toes.

Another desirable object of the present invention is to provide a toe cleaning device which provides a compact, convenient and safe means for effective cleaning between the toes as well as providing a soothing massage to the area between the toes.

A still further desirable object of the present invention is to provide a device for cleaning between toes which can be easily operated and without harm.

A still further desirable object of the present invention is to achieve the above desirable objects with an essentially simple structure lending itself to inexpensive mass production.

These and other desirable objects of the present invention will in part appear hereinafter and will in part become apparent after consideration of the specification with reference to the drawings and the claims.

SUMMARY OF THE INVENTION

The present invention discloses a new and improved device for treating the skin area between adjacent toes. The treating of the present invention includes, for example, cleaning the area between the toes and soothing and massaging the area between toes. It should be mentioned that the area between the toes is often overlooked when it comes to personal hygiene, or in many cases, too difficult to get at without the risk of injury. If the area between the toes is not maintained properly, fungus, bacteria and other substances may get trapped which can cause foul odors, foot fungus, as well as infection. The present invention provides a compact, convenient and safe device for effective cleaning between the toes as well as providing a soothing massage to the area between the toes. The preferred embodiment of the device of the present invention for cleaning between the toes comprises a base section, an elongated uniform size flexible section for cleaning between the toes with the bottom end attached to the base section and the upper end of the cleaning section terminating with a holding device.

The flexible cleaning device section is formed of flexible material such as cotton, plastic or rope type material whereby one end is attached to the base device section and the other end attached to the holding device section. It is to be understood that the cleaning device section is a uniform size from the base section device to the upper holding section device and can be made of different abrasives for cleaning between the toes. As will be discussed in detail hereinafter, the present invention, rather than having the cleaning device doing the movement for the cleaning, provides that the space between toes was of the individual's foot is inserted into the uniform cleaning device section of the present invention and the foot is raised and lowered up and down the uniform cleaning device section by the individual.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENTS

Figure 1:
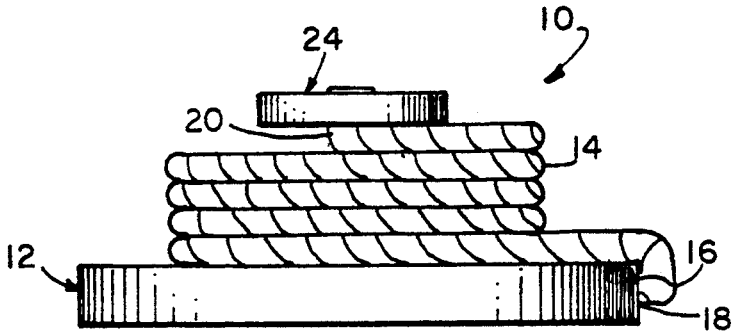
FIG. 1 is a side plan view illustrating one embodiment of a flexible toe cleaning device embodying the principles of the present invention and showing the flexible toe cleaning device in a releasable engaged position when not in use.
Figure 2:
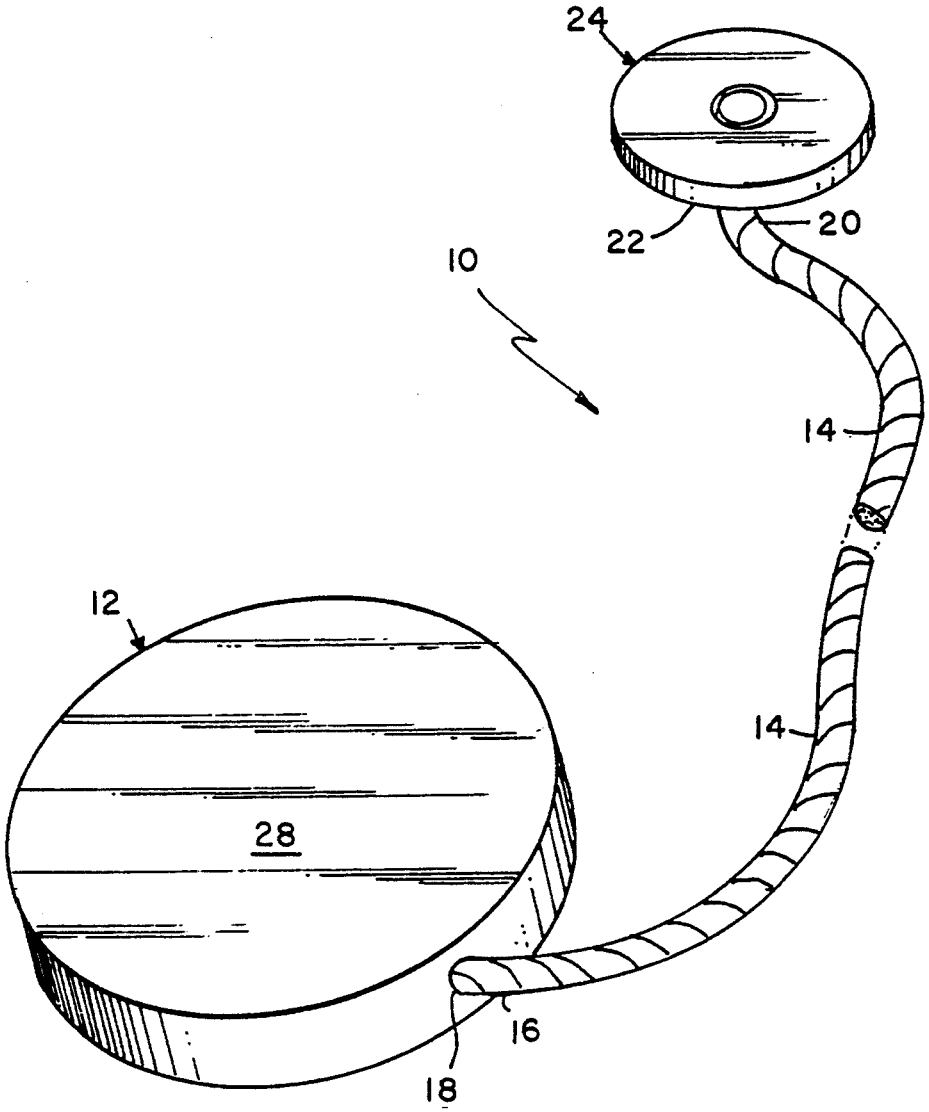
FIG. 2 is a perspective view illustrating the flexible toe cleaning device of FIG. 1 in the open usable position.

Referring now to the drawings and more particularly to FIGS. 1–4, there is illustrated an embodiment of the principles of the present invention device for cleaning between toes indicated generally by the reference numeral 10. As illustrated, the device 10 for cleaning between toes includes a base section 12, an elongated uniform size flexible section 14 for cleaning between the toes with the bottom end 16 attached to the side section 18 of the base section 12. The top end 20 of the flexible section 14 is attached to the bottom portion 22 of the circular holding device 24 which is held by the user's hand or hands. As illustrated in FIG. 1, the flexible device 10 when not being used can be converted into a releasable engaged position.

Figure 3:
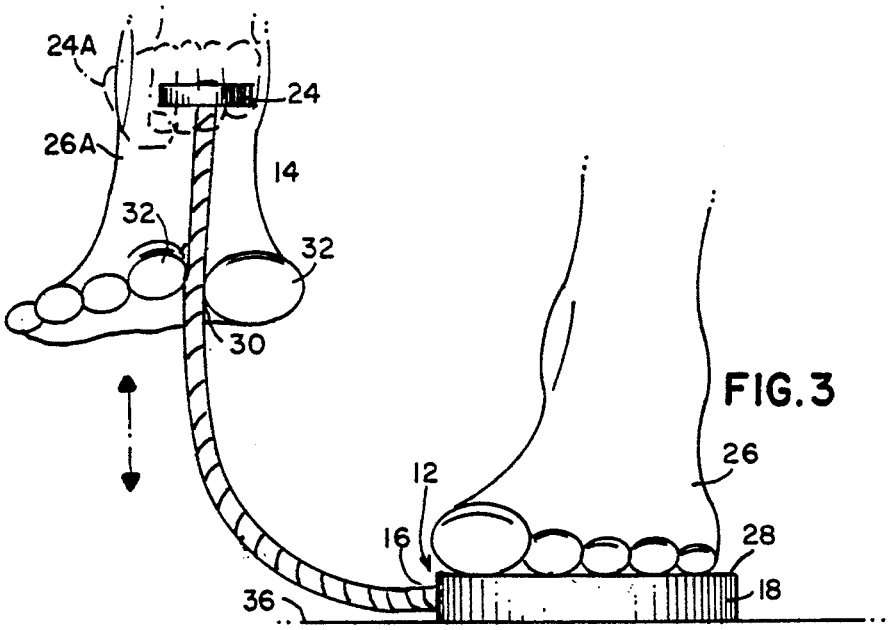
FIG. 3 is a front elevational view of the flexible toe cleaning device of the present invention as being applied in operating position to a spacing between toes.
Figure 4:
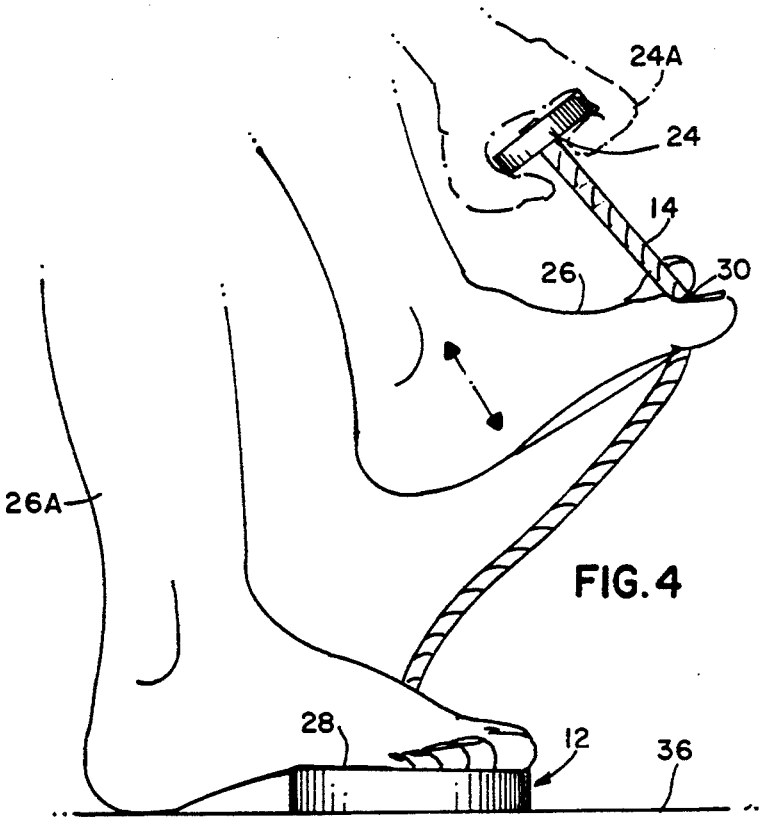
FIG. 4 is a side elevational view of the flexible toe cleaning device of the present invention as being applied in operating position to a spacing between toes.

Referring now to FIGS. 3 and 4, there is illustrated the installation and use of the device for cleaning between toes. In FIG. 3 the user operates by applying the left leg foot 26 on to the top surface 28 of the base section 12 which is placed on a floor 36, for example. The flexible cleaning section 14 is placed on the inner side so that it is inserted into a space 30 between the toes 32 of the right foot 26A. The holding device 24 is held by the user's hand 34. In this position the device 10 for cleaning between spaces 30 between toes permits the right foot leg 26A to be moved up and down as indicated by the arrows to clean the space 30 between the toes. FIG. 4 is similar except that the spaces 30 are being cleaned on the left leg foot 26 with the right foot 26A on the base section 12 and the left hand 24A holding the upper device 24.

Figure 5:
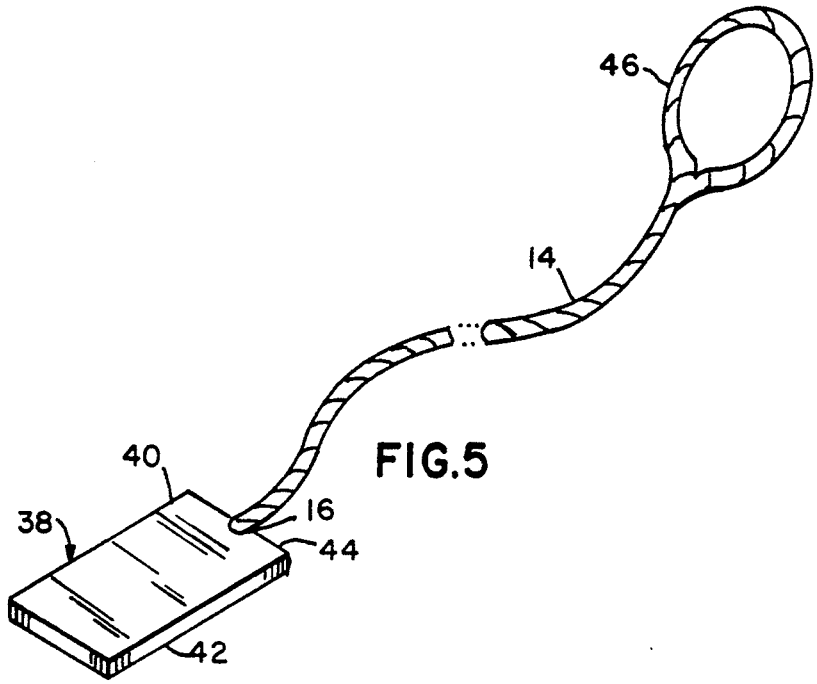
FIG. 5 is a perspective view illustrating an alternate embodiment of the flexible toe cleaning device of the present invention.

Referring now to FIG. 5, there is illustrated an alternate embodiment of the present invention device for cleaning between toes. As illustrated the base section 38 is formed as a rectangular section with a top surface 40 and a bottom surface 42. The base may also have a square or circular configuration. The bottom end 16 of the elongated uniform size flexible device section 14 is attached to the side section 44 of the base section 38. The top portion of the flexible device section 14 is formed as a hand-grip loop device portion 46.

Figure 6:
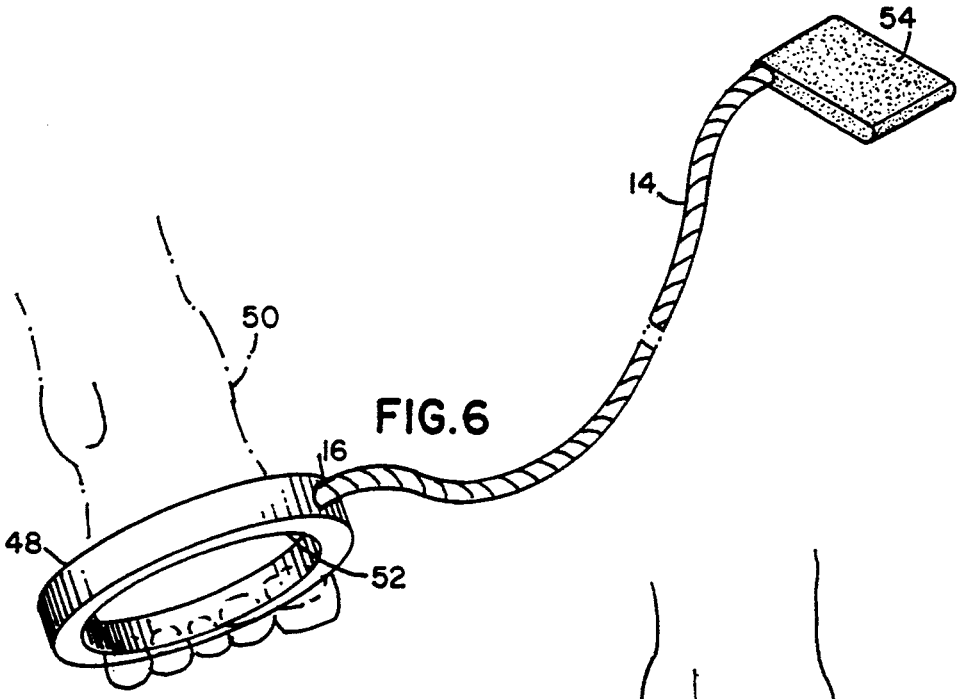
FIG. 6 is a perspective view illustrating an alternate embodiment of the flexible toe cleaning device of the present invention.
Figure 6A:
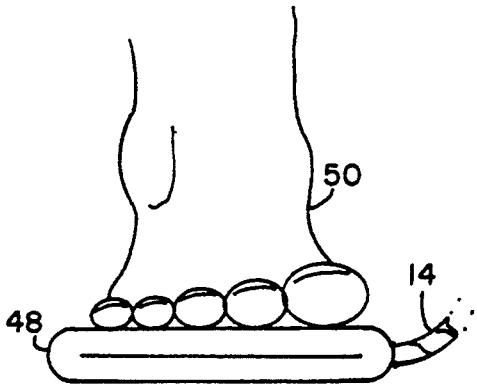
FIG. 6A illustrates an alternate means of applying a foot to the base device section of FIG. 6.

Referring now to FIG. 6 there is illustrated an alternate embodiment of the present invention device for cleaning between toes. As illustrated the base section device 48 is a loop device whereby a foot 50 is inserted into the open area 52 to hold it in position during operation use. As illustrated in FIG. 6A the foot 50 can also be placed on top of the base section device 48 in the same manner as illustrated in FIGS. 3 and 4. The top hand holding device 54 is formed of a face cloth type material which can also be used as a cleaning device for cleaning other parts of the body.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A device for cleaning the area between toes of a user comprising:

a base device forming a sufficient top and bottom horizontal areas capable of being releasably secured by one foot of the user;

an elongated flexible cord line device having a bottom end and an upper end;

said bottom end of the elongated flexible cord attached to a side section of the base device;

a hand holding device formed of a cloth cleaning material is attached to the upper end of the elongated flexible cord line device to be held by a hand of a user;

said elongated flexible cord line device is of uniform size from the lower end to the upper end; and said elongated flexible cord line being such that it enters the area between toes of the user's foot whereby the user's foot is raised and lowered up and down the flexible cord line to clean the area between the toes.

2. The toe device of Claim 1 wherein the upper end of the elongated flexible cord device includes a hand-grip loop device capable of being held by a user's hand.

3. The toe device of claim 1 wherein the base device has a circular configuration.

4. The toe device of claim 1 wherein the base device has a square configuration.

5. The toe device of claim 1 wherein the base device has a rectangular configuration.

6. A device for cleaning the area between toes of a user body comprising:

an elongated flexible cord line device having a uniform thickness size extending from a lower end to an upper end;

said elongated flexible cord line device being such that it enters the area between toes of the user's foot whereby the user's foot is raised and lowered up and down the flexible cord line to treat the area between the toes;

a loop device attached to the lower end of the flexible cord device capable of being releasably secured by a foot of the user; and a hand holding device attached to the upper end of the flexible cord device;

said hand holding device is formed of a cloth cleaning material.

7. The toe device of claim 6 wherein said loop device is of sufficient size to have a foot of a user releasably inserted to be held in position.

* * * * *